United States Patent [19]

Moore

[11] Patent Number: 4,641,119

[45] Date of Patent: Feb. 3, 1987

[54] LAMINAR MAGNET FOR MAGNETIC RESONANCE DEVICE AND METHOD OF MAKING SAME

[75] Inventor: John F. Moore, Lake Bluff, Ill.

[73] Assignee: Kabushiki Kaisha Toshiba, Kawasaki, Japan

[21] Appl. No.: 725,340

[22] Filed: Apr. 19, 1985

[51] Int. Cl.[4] ..... H01F 3/00

[52] U.S. Cl. ..... 335/297; 324/319; 29/609

[58] Field of Search ..... 335/281, 296, 297, 299; 324/318, 319, 320, 321; 29/602, 609

[56] References Cited

U.S. PATENT DOCUMENTS 4,498,048 2/1985 Lee et al. ..... 324/318 X

FOREIGN PATENT DOCUMENTS 57-37812 3/1982 Japan ..... 335/297

1189918 4/1970 United Kingdom ..... 335/297

*Primary Examiner*—George Harris

*Attorney, Agent, or Firm*—Finnegan, Henderson, Farabow, Garrett & Dunner

[57] ABSTRACT

A magnet and method for making same for use in a magnetic resonance imaging device comprising a plurality of laminated ribbon strips of magnetically conductive material, the strips each bent along their lengths to form curved cross sections of similar shape but of progressively larger size and progressively larger widths.

27 Claims, 13 Drawing Figures

Fig. 7
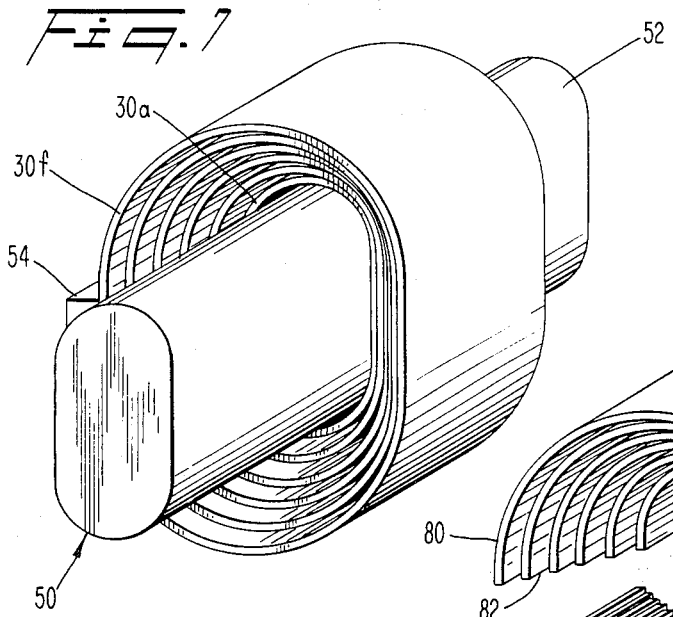
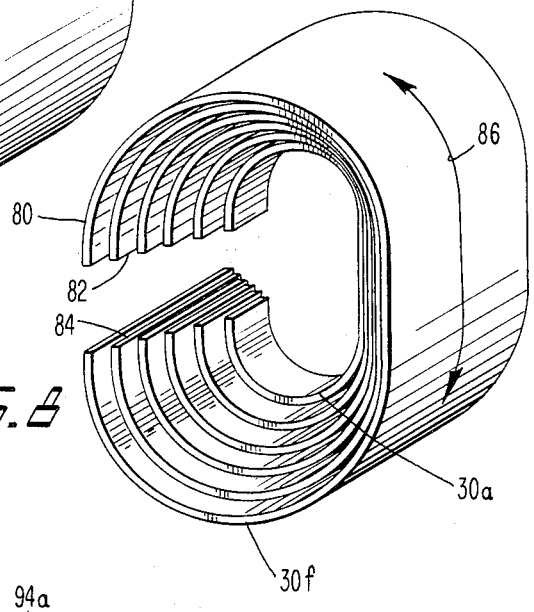
Fig. 8
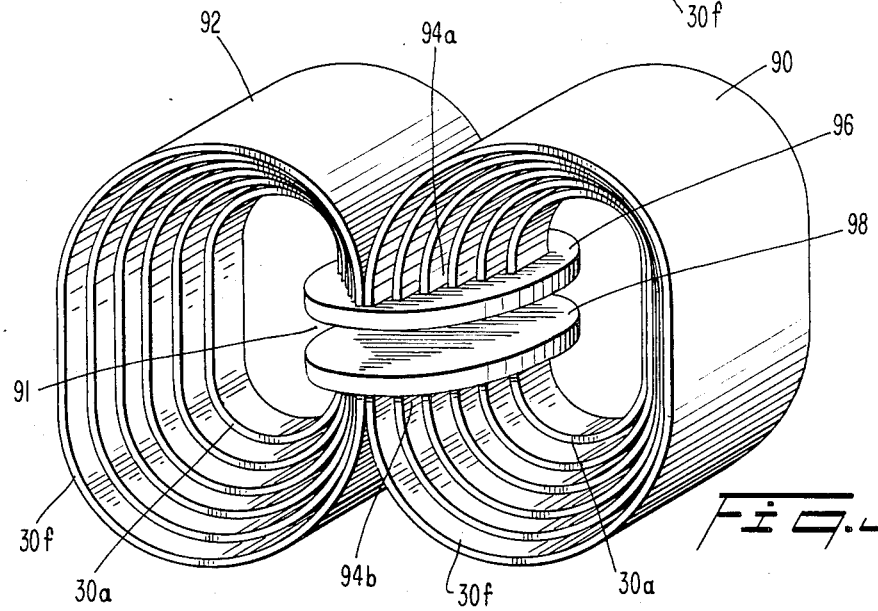
Fig. 9

Fig. 12
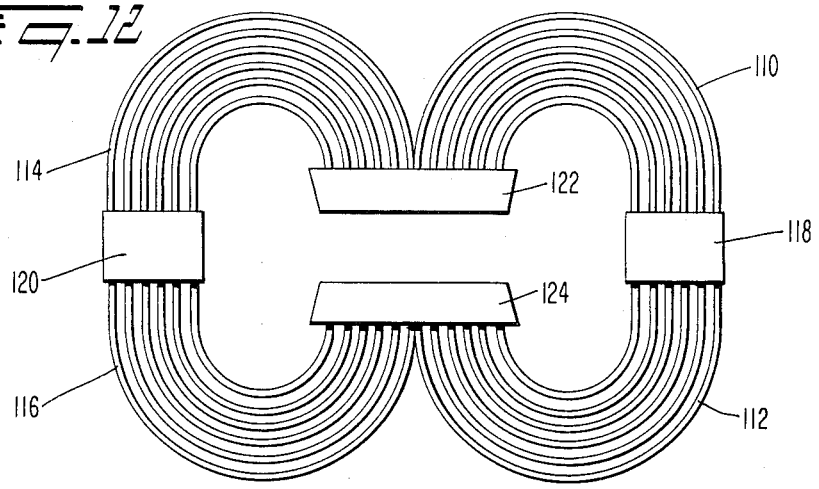
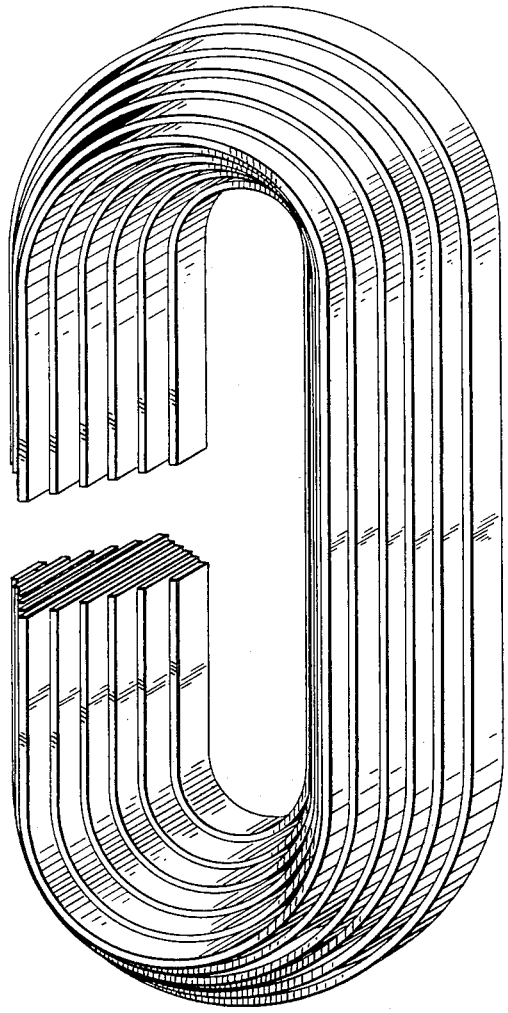
Fig. 13

LAMINAR MAGNET FOR MAGNETIC RESONANCE DEVICE AND METHOD OF MAKING SAME

BACKGROUND OF THE INVENTION

I. Field of the Invention

The present invention relates to a magnet for use in a magnetic resonance imaging device and to methods for making that magnet.

II. Background Information

Magnetic resonance imaging devices require that the target area to be imaged be subjected to a large uniform magnetic field on the order of 1.5 to 60 kiloGauss. In the past, electromagnets have been used which employ large conductive coils through which substantial amounts of current are passed. A magnetic field is thus created in the open space inside the coils and a return path is provided in the open space outside the coils. The magnetic field produced by such electromagnetic devices is not contained within any fixed return path and, therefore, such magnets have the disadvantage of being subjected to the adverse effects of nearby ferrous metallic objects which could result either in damage to those objects or to disruption of the uniform nature of the field inside the coils.

To avoid these disadvantages, prior art devices have been made available which employ permanent magnetic pole pieces which are separated from one another and between which the requisite magnetic field for magnetic resonance imaging is developed. In these devices, magnetic field conductive material, such as iron, is employed to provide a return path for the magnetic field between the poles. There are, however, several disadvantages to this type of prior art magnet. First, this type of magnet is extremely heavy and extremely difficult to manufacture and transport due to its weight and size. In addition, this type of prior art magnet typically has sharp corners in the return path which create discontinuities in the return magnetic field path. These discontinuities can adversely effect the uniformity of the field between the magnetic pole pieces, and can contribute to the leakage of field into the space outside the magnet. Furthermore, large, solid masses with appropriate magnetic field conductive properties are expensive to obtain.

In view of the foregoing, proprietary corporate research has been conducted on behalf of the assignee of the subject application. Although the results of these investigations were under the control of the assignee of the subject application at the time of the subject invention and, therefore, are not prior art, these investigations are nevertheless of interest in understanding the development of the subject invention.

Specifically, these investigations were directed toward the construction of a laminar magnet for use in a magnetic resonance imaging device. For example, as shown in FIG. 1, a magnet 10 was contemplated which comprised a plurality of stacked plates, for example illustrated plates 12*a*–12*i*. Plates 12*a*–12*i* could be stacked together to form magnet 10. Each of plates 12*a*–12*i* may comprise a top portion 14, a bottom portion 16, a first side portion 18, a second side portion 20, and oppositely facing teeth 22 and 24. Top portion 14 and bottom portion 16 are joined together at their edges by side portions 18 and 20 to form a generally square or rectangular shape. Extending down from top portion 14 toward bottom portion 16 is a top tooth 22 and extending upward from bottom portion 16 toward top portion 14 is lower tooth 24. As may be seen in FIG. 2, teeth 22 and 24 of plate 12*a* are narrower than teeth 22 and 24 of plate 12*b*, which, in turn, are narrower than teeth 22 and 24 of plate 12*c*.

Following prior art in the manufacture of electrical transformers, the grain orientation of the portions 14 through 24*a* of the plates 12*a*–12*i* is aligned insofar as possible parallel to the magnetic field. This grain orientation is shown in FIGS. 1 and 2 for plate 12*a* by the vertical arrows in portions 18, 20, 22, and 24 and by the horizontal arrows in portions 14, 15, 16, 17, 19, and 21.

Again following prior art in the manufacture of electrical transformers, the plates 12*a*–12*i* might be alternated with plates such as plate 12*i* of FIG. 2 whose grain orientation is similar to that in plate 12*a* except for the locations where the portions meet. Those locations in plate 12*i* are staggered oppositely to those in plate 12*a*, as shown in FIG. 2, thereby ensuring that the assembly will be mechanically strong at the locations where the portions meet. To this end, the side portions 18 and 20, which in plate 12*a* do not include the corners, are extended so as to include them in the case of side portions 18*a* and 20*a* in plate 12*i*. Likewise, the teeth 22 and 24, which in plate 12*a* do not extend to the outer edge of the plate, are so extended as shown by teeth 22*a* and 24*a* of plate 12*i* in FIG. 2. As a result, the top and bottom portions 14 and 16 of plate 12*a* are replaced by separate portions 15, 17, 19, and 21 of plate 12*i*.

Teeth 22*a* and 24*a* of plate 12*i* may also be made of progressively varying width.

FIG. 3 shows teeth 24 of plates 12*a*–12*i* when plates 12*a*–12*i* are assembled to form magnet 10. As may be seen in FIG. 3, the width of teeth 24 continues to get progressively larger from plate 12*a* to middle plate 12*m*, after which teeth 24 get progressively smaller so that the resultant structure of teeth 24, when plates 12*a* through 12*i* are assembled, is a general cylindrical pole piece as is illustrated in FIG. 1. Similarly, upper teeth 22 form a second generally cylindrical pole piece as is also shown in FIG. 1. Varying width teeth 24*a* of plates arranged with grain orientation like that of plate 12*i* may, of course, be used to selectively replace teeth 24 of plates arranged like plate 12*a*.

Although relatively easy to assemble and constructed of relatively inexpensive plates 12*a*–12*i* instead of a solid piece of iron, the magnet of FIGS. 1–3 has a fundamental disadvantage. Specifically, any magnetically conductive material has a preferred direction or orientation, as mentioned above, for conducting a magnetic field through that material. Even if portions 14 through 20 of each plate were made of independent sections of conductive material whose preferred orientation of magnetic conduction were aligned in the most preferable manner as shown by the arrows of plates 12*a* and 12*i*, there would nevertheless exist discontinuities at the points of connection between teeth 12 and top portion 14, top portion 14 and side portions 18 and 20, side portions 18 and 20 and bottom portion 16, and bottom portion 16 and teeth 24. Also, even with curved corners as shown in FIGS. 1 and 2, magnetic flux will emerge at these corners because the direction of magnetic conduction itself is not curved.

It is, accordingly, an object of the subject invention to provide a magnet for use in a magnetic resonance imaging device which is of economic laminar construction and within which a return path is formed without discontinuities in the preferred orientation of magnetic field conduction within that return path.

Additional objects and advantages of the invention will be set forth in the description which follows, and in part will be obvious from the description or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, a magnet for use in a magnetic resonance imaging device is provided comprising: (a) means for generating a magnetic field; and (b) means for providing a return path or paths for that magnetic field including a plurality of ribbon strips of magnetically conductive material, these strips each being bent along their lengths to form a curved longitudinal cross section (viewed from the edge of each strip) with the cross sections being similar in shape and different in size from strip to strip, and these strips being stacked together with strips of smaller radius of curvature located inside strips of larger radius of curvature to form a return path having a longitudinal cross section of the shape of each individual strip.

Preferably the widths of the strips progressively increase from the inside to the outside of the return path in such a manner as to form half of the desired shape of a pole piece or gap, such as one-half of a circle, ellipse, or other symmetrical shape, if two such assemblies are used. If one assembly is used, the widths may increase and then decrease in such a manner as to form all of the desired shape of a pole piece or gap.

In accordance with another aspect of the subject invention, a method is provided for making such a magnet comprising the steps of: (a) selecting a form having the size and shape of an inside surface of the magnetic flux return path for the magnet; (b) stacking a plurality of ribbon strips of magnetic conductive material together around that form by bending each of the ribbon strips along their lengths and in succession over the form and over any previously so bent ribbon strip on the form; and (c) attaching means for generating a magnetic field to the bent ribbon strips.

BRIEF DESCRIPTION OF THE DRAWINGS

The accompanying drawings, which are incorporated in and constitute a part of the specification, illustrate a preferred embodiment of the invention and, together with the general description given above and the detailed description of the preferred embodiment given below, serve to explain the principles of the invention.

FIG. 7 is a perspective view of one-half of a magnet built in accordance with the teachings of the present invention;

FIG. 8 is another perspective view of the half-magnet of FIG. 7;

FIG. 9 is a perspective view of another magnet built in accordance with the teachings of the present invention;

FIG. 12 is a side view of still another magnet built in accordance with the teachings of the subject invention; and FIG. 13 is a perspective view of the return path of a further magnet built in accordance with the teachings of the subject invention.

DESCRIPTION OF THE PREFERRED EMBODIMENT

Reference will now be made in detail to the present preferred embodiment of the invention as illustrated in the accompanying drawings.

Figure 1:
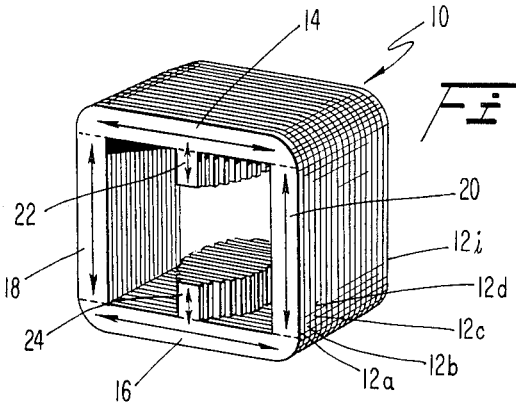
FIG. 1 is a perspective view of a laminar magnet for use in a magnetic resonance imaging device, wherein planar laminar sections are employed.
Figure 2:
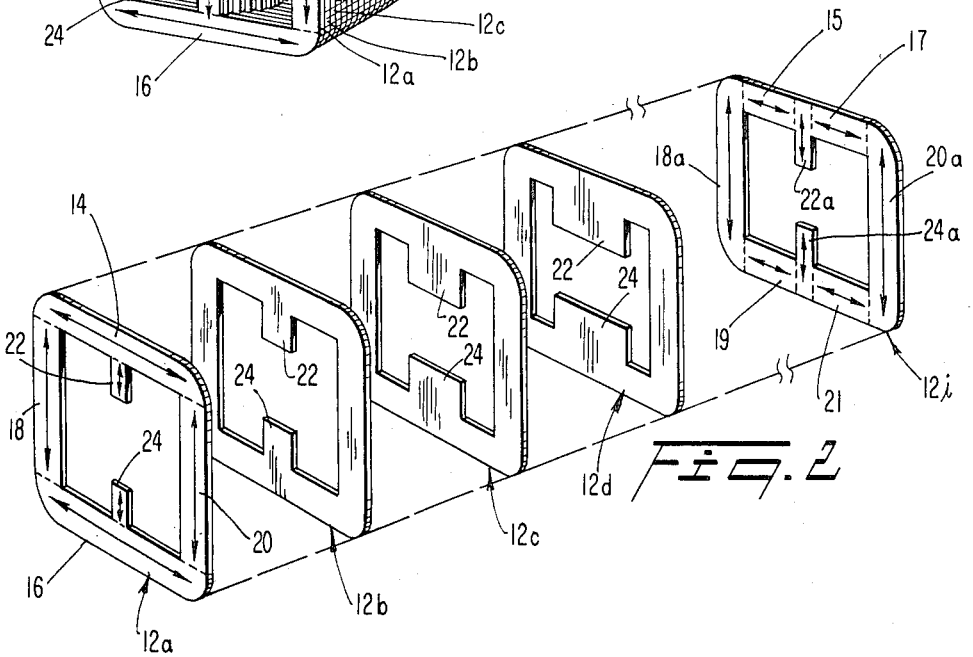
FIG. 2 is an exploded perspective view of the laminar plates comprising the magnet illustrated in FIG. 1.
Figure 3:
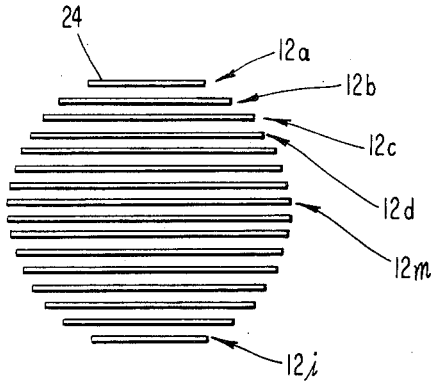
FIG. 3 is an end view of one pole piece of the magnet illustrated in FIG. 1.
Figure 4:
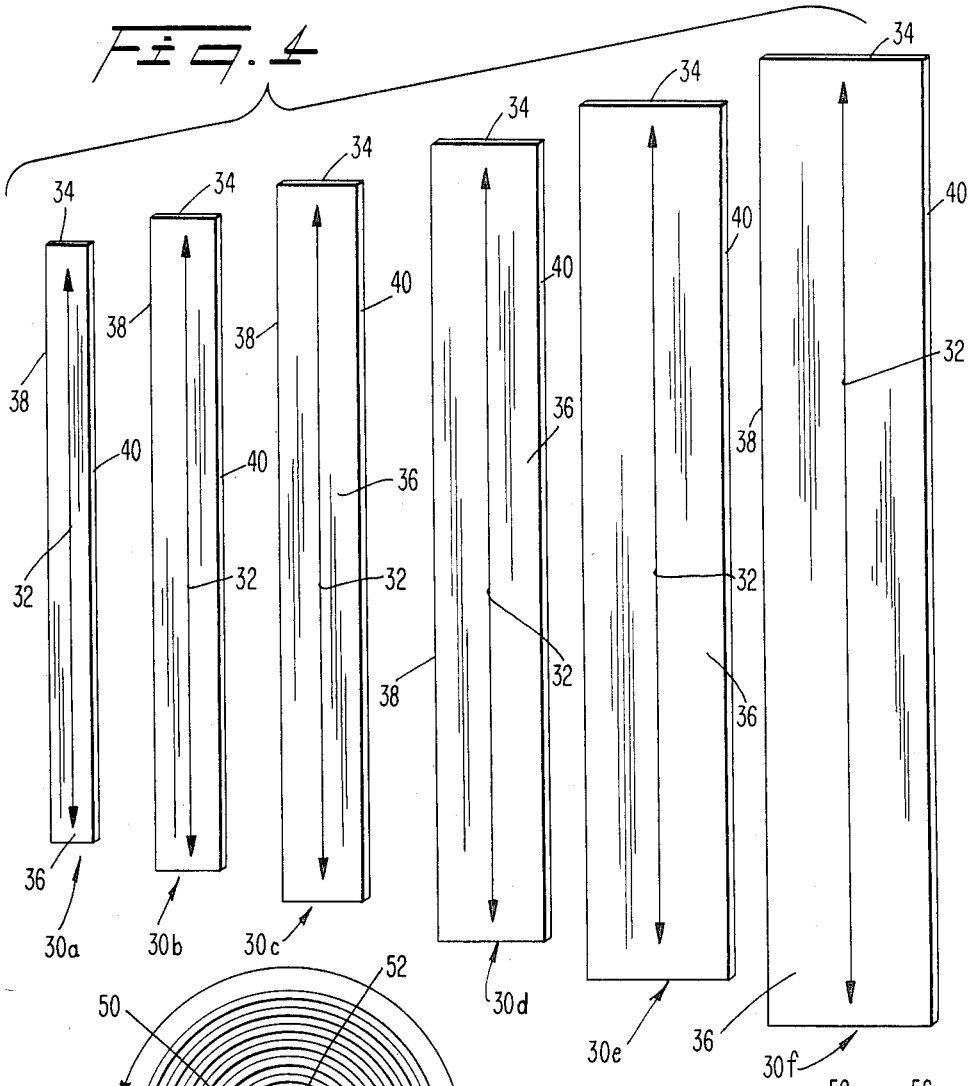
FIG. 4 is a perspective view of a plurality of ribbon strips which are employed to form a magnet in accordance with the teachings of the present invention.

In FIG. 4 there are illustrated a plurality of substantially rectangular ribbon strips 30*a*–30*f*. Each of ribbon strips 30*a*–30*f* preferably is formed of a ribbon material with high magnetic saturation capability having a grain orientation along the length of strips 30*a*–30*f* as illustrated by arrows 32. Each of strips 30*a*–30*f* have oppositely disposed ends 34 and 36 and oppositely disposed elongated edges 38 and 40. Accordingly, ends 34 and 36 run the width of each of strips 30*a*–30*f* and edges 38 and 40 run along the length of strips 30*a*–30*f*.

As is further illustrated in FIG. 4, strip 30*b* has a slightly greater dimension along ends 34, 36 than strip 30*a*. Similarly, strip 30*c* has a slightly greater dimension along ends 34, 36 than strip 30*b*. This relationship between strips continues through to and including strip 30*f*, which has the largest dimension along ends 34, 36. Similarly, as illustrated in FIG. 4, strip 30*b* has a slightly longer dimension along edges 38, 40 than strip 30*a*. Strip 30*c* also has slightly longer dimensions along edges 38, 40 than strip 30*b*. This relationship between strips continues on through strip 30*f* which has longer dimensions along edges 38 and 40 than any other strip 30*a*–30*e*.

Although only strips 30*a* through 30*f* are illustrated in FIG. 4, it is to be understood that a greater number of strips may be employed than those illustrated in FIG. 4 to construct a magnet in accordance with the teachings of the present invention.

Figure 5:
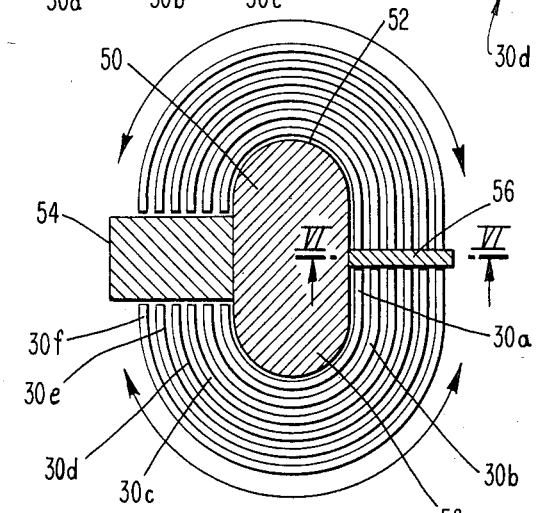
FIG. 5 is a side view of a magnet constructed in accordance with the teachings of the present invention.
Figure 6:
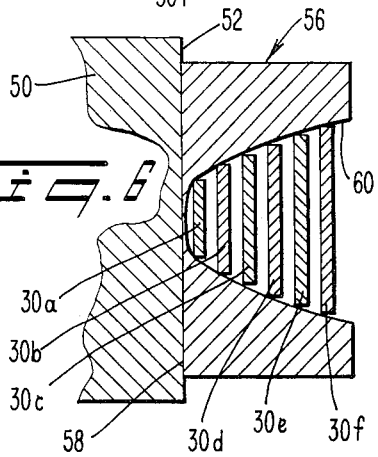
FIG. 6 is a cross sectional view of the magnet of FIG. 5 taken along line VI—VI.

FIGS. 5, 6, and 7 illustrate the assembly of strips 30*a*–30*f* of FIG. 4 into a magnetic field conduction return path built in accordance with the teachings of the present invention. As shown in FIGS. 5, 6, and 7, there is illustrated a form 50 which has been shaped to have an outer surface 52 which conforms to the desired size and shape of the inner path of a magnetic flux return path for a magnetic resonance imaging magnet. A spacer 54 is positioned adjacent form 50 to define an opening between opposite ends of ribbon strips 30*a*–30*f* and thereby permit ribbon strips 30*a*–30*f* to be formed in the shape of a "C" or other suitable shape when strips 30*a*–30*f* are successively bent over surface 52 of form 50. Form 50 and spacer 54 may be made of any suitable material, such as wood or metal, which can be readily removed from strips 30*a*–30*f*.

There is further illustrated in FIGS. 5 and 6 a jig 56 which has a first surface 58 abutted against surface 52 of form 50 opposite spacer 54. Jig 56 has a second surface 60 which is shaped to receive increasingly wider strips 30*a*–30*f*. It should be understood that, for ease or accuracy of manufacture, a plurality of jigs 56 may be used, spaced around the assembly of ribbons 30*a*–30*f* in FIGS. 5 and 6.

In accordance with the teachings of the present invention, a magnet of the subject invention is formed by stacking a plurality of ribbon strips of magnetic conductive material together and around a suitable form by bending each of those ribbon strips along their lengths and successively over the form and over any previously so bent ribbon strips on the form.

By way of example and not limitation, as diagrammatically shown in FIGS. 5–7, ribbon strip 30*a* is first bent over form 50 to form the shape of a "C". Subsequently, ribbon strip 30*b* is bent over ribbon strip 30*a* on form 50 to form a similar shape "C" of slightly larger size. This process is continued through strips 30*c*, 30*d*, 30*e* and 30*f* and with regard to any additional strips which may also be employed. These additional strips are preferably of increasing width, although once a maximum width is reached, additional strips of successively narrowing width may also be employed.

It is to be understood that not every strip need be of a different width than the width of an adjacent strip, all that is required for the preferred embodiment of the subject invention is that the strips be stacked together with smaller size strips, i.e. strips with smaller radius of curvature, located inside larger size strips. Additionally, the strips may be made to progressively increase in width from the inside to the outside of the resultant structure to form a laminar structure having a transverse cross-section which has the approximate shape of a semi-circle.

The stacked strips may be held together by any suitable method, such as by conventional bonding techinques or mechanical fastening.

FIG. 8 is a perspective view of the stacked ribbon strips 30*a*–30*f* of the FIG. 7 assembly with form 50 and jig 54 removed. In stacked form strips 30*a*–30*f* comprise a magnetic return path 80 which has oppositely facing ends 82 and 84. Since return path 80 comprises a plurality of ribbon strips each of which has a direction of preferred magnetic field propagation oriented along its length, the direction of preferred magnetization illustrated by arrow 86 in FIG. 8 is parallel to the internal magnetic return field which is established within return path 80.

To establish a magnetic field within return path 80 it is necessary that some form of magnetic field generating device be affixed to return path 80, unless the ribbons which comprise return path 80 are themselves permanent magnets.

For instance, in FIG. 9, two return paths 90 and 92 which are each similar in nature to return path 80 of FIG. 8, are assembled adjacent to one another, and at their respective ends 94*a* and 94*b* there are affixed pieces of permanently magnetized materials 96 and 98 in the form of sections of cylinders, cones, or other shapes suitably chosen for best uniformity of the field in gap 91. Permanently magnetized materials 96 and 98 form pole pieces between which a uniform magnetic field may be established in gap 91. Return paths 90 and 92 operate together to provide an internal magnetically conductive return path for the magnetic field that has a direction of preferred magnetization that is parallel to the internal field within return paths 90 and 92. Permagnetic materials 96 and 98 accordingly provide one example of a mechanism whereby a magnetic field may be established for which return paths 90 and 92 may be employed.

Figure 10:
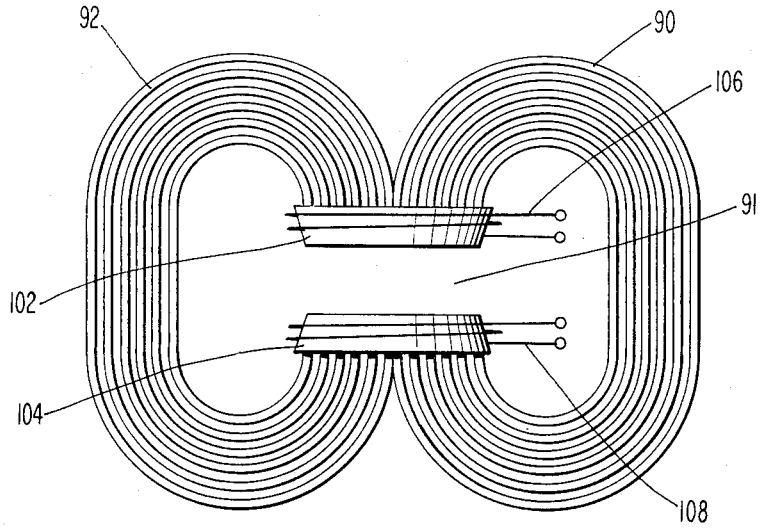
FIG. 10 is a side view of another magnet built in accordance with the teachings of the subject invention.

FIG. 10 illustrates another example of a mechanism whereby a magnetic field may be generated within return paths 90 and 92. In FIG. 10, non-permanent magnetic pole pieces 102 and 104 are coupled to the open ends of return paths 90 and 92 to form oppositely facing pole pieces. Electrical coils 106 and 108 are wrapped around pole pieces 102 and 104, respectively. When energized, coils 106 and 108 form a magnetic field between pole pieces 102 and 104, the return path for which comprises return paths 90 and 92.

Figure 11:
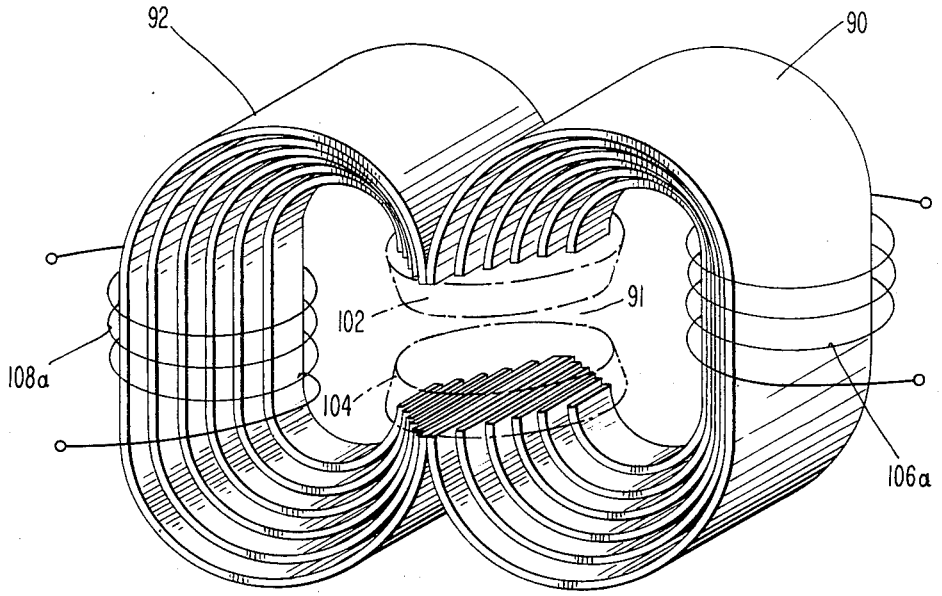
FIG. 11 is a perspective view of still another magnet built in accordance with the teachings of the subject invention.

In FIG. 11 a perspective view of a magnetic assembly like that shown in FIG. 10 is illustrated. In FIG. 11, coils 106*a* and 108*a* are shown wrapped around return paths 90 and 92, respectively, and pole pieces 102 and 104 are shown to be optional.

FIG. 12 illustrates still a further embodiment of a magnet constructed in accordance with the teachings of the subject invention. In FIG. 12 a return path built in accordance with the teachings of the subject invention, has been cut in half to form two U-shaped return paths 110 and 112. A second such return path has also been cut in half to form U-shaped return paths 114 and 116. A first permanent magnet 118 is located between first ends of return paths 110 and 112 and a second permanent magnet 120 is located between first ends of return paths 114 and 118.

First and second pole pieces 122 and 124 are shown magnetically coupled to the other ends of return paths 110 and 114 and to the other ends of return paths 112 and 116, respectively.

In the resultant magnet illustrated in FIG. 12, a magnetic field is generated in return paths 110 and 112 by magnet 118 and a magnetic field is generated within return paths 114 and 116 by magnet 120. These two magnetic fields combine at pole pieces 122 and 124 and a uniform magnetic field is thereby generated between pole pieces 122 and 124.

As noted above, the strips forming the return path may be made to progressively increase in width from the inside to the outside and then decrease in width to form a laminar structure having a transverse cross section which has the approximate shape of a complete circle, as is shown in FIG. 13. Moreover, the transverse cross section of return path and/or of any pole pieces attached to the return path may be elliptical, hypercircular, or of special shape to meet the requirements of a specific application.

In summary, laminations of succesively wider width ribbon pieces are bent or wound around a suitably shaped form such as an oval form, with this bending or winding achieved in conjunction with removable forms and jigs which keep the lamination centered until bonding material can harden or appropriate mechanical bonding can be secured. A spacer may be employed to keep one side of the resultant C-shaped or similar shaped ribbons open. After removal of the form, the ends of the resultant "C"s may be ground to fit appropriate pole pieces, such as cylindrical, tapered, or shaped pole pieces and, preferably, two of these C-shaped laminar structures are united together at the fitted pole pieces.

The preferred magnetization path will, accordingly, follow the resultant curve of the ribbon pieces thereby eliminating any discontinuities within the resultant return paths. Simple, economical, and lightweight strips can be used, thereby eliminating waste.

In an alternative, four U-shaped laminar pieces are constructed and used with permanent magnetic sections inbetween. In this embodiment, two U-shaped sections could be cut from a larger section formed as stated above, for example from a substantially continuous loop wound on the form as described above but without the utilization of a spacer.

Instead of using only laminations of successively wider width ribbons, after a maximum width is reached, successively narrower width ribbons may be used to complete the transverse cross section of the resultant laminar piece.

Additional advantages and modifications will readily occur to those skilled in the art. The invention in its broadest aspects is, therefore, not limited to the specific details, representative apparatus, and illustrative examples shown and described. Accordingly, departures may be made from such details without departing from the spirit or scope of applicant's general inventive concept.

I claim:

1. A magnet for use in a magnetic resonance imaging device comprising:

(a) means for generating a magnetic field; and (b) means for providing a return path for said magnetic field including a plurality of ribbon strips of magnetically conductive material, said strips each bent along their lengths to form a curved cross section along the edge of each strip, with said cross section similar in shape from strip to strip, and said strips stacked together to form a return path having a cross-section of said shape.

2. The magnet of claim 1 wherein the radius of curvature of said cross-section is different in size from strip to strip and smaller size radius of curvature cross-section strips are located inside large radius of curvature size cross-section strips.

3. The magnet of claim 1 wherein the width of said strips progressively increases from the inside to the outside of the return path.

4. The magnet of claim 1 wherein the width of said strips progressively increases and, once a maximum width is obtained, progressively decreases from the inside to the outside of the return path.

5. The magnet of claim 1 wherein the surface of each of said strips is rectangular in shape.

6. The magnet of claim 1 wherein said shape is a "U".

7. The magnet of claim 6 wherein said means for providing a return path includes two of said U-shaped return paths, each of said U-shaped return paths having a first and a second end.

8. The magnet of claim 7 wherein said means for generating a magnetic field comprises a first permanent magnet, with said first permanent magnet magnetically coupled between said first ends of said U-shaped return paths.

9. The magnet of claim 8 wherein said means for generating a magnetic field includes first and second pole pieces spaced apart from one another to permit said magnetic field to be formed therebetween, with said first and second pole pieces magnetically coupled to said second ends of said U-shaped return paths, respectively.

10. The magnet of claim 9 wherein said first and second pole pieces comprise second and third permanent magnets, respectively.

11. The magnet of claim 10 wherein said shape is a "C".

12. The magnet of claim 11 wherein said means for generating a magnetic field includes first and second pole pieces spaced apart from one another to permit said magnetic field to be formed therebetween, with said first and second pole pieces magnetically coupled to respective ends of said C-shaped return path.

13. The magnet of claim 12 wherein said first and second pole pieces comprise first and second permanent magnets, respectively.

14. The magnet of claim 12 wherein said means for generating a magnetic field includes first and second coils located around said first and second pole pieces, respectively, to generate said magentic field between said pole pieces upon activation of said coils.

15. The magnet of claim 11 wherein said means for generating a magnetic field includes a coil located around said C-shaped return path.

16. The magnet of claim 11 wherein said means for providing a return path includes two of said C-shaped return paths.

17. The magnet of claim 16 wherein at least one of said C-shaped return paths comprises two U-shaped return paths magnetically coupled together.

18. A method for making a magnet for use in a magnetic resonance imaging device, comprising the steps of:

(a) selecting a form having the size and shape of an inside surface of a magnetic flux return path for said magnet;

(b) stacking a plurality of ribbon strips of magnetic conductive material together and around said form by bending each of said ribbon strips along their length over said form and over any previously so bent ribbon strips on said form; and (c) attaching means for generating a magnetic field to said bent ribbon strips.

19. The method of claim 18 wherein said form has an oval cross section and wherein said method includes the step of positioning a spacer adjacent said form to define an opening between the opposite ends of said ribbon strips employing said spacer in said step of bending to structure said bent ribbon strips in the shape of a "C".

20. The method of claim 18 wherein said step of attaching includes the step of magnetically coupling permanent magnet pole pieces, one to each end of said C-shaped ribbon strips.

21. The method of claim 18 wherein said step of attaching includes the step of magnetically coupling pole pieces one to each end of said C-shaped ribbon strips and fixing a coil around each said pole piece.

22. The method of claim 18 wherein said step of attaching includes the step of magnetically coupling pole pieces one to each end of said C-shaped rippon strips and fixing a coil around the outside of said ribbon strips to generate a magnetic field in said ribbon strips upon activation of said coil.

23. The method of claim 18 including the step of cutting said bent ribbon strips to form at least two sets of bent ribbon strips each in the shape of a "U".

24. The method of claim 23 wherein said step of attaching includes the step of magnetically coupling a permanent magnet between one end of each of said U-shaped ribbon strips and magnetically coupling pole pieces one to each of the other ends of said U-shaped ribbon strips.

25. The method of claim 18 wherein said step of stacking includes the substep of selecting at least a portion of said ribbon strips to be stacked with progressively greater widths.

26. The method of claim 25 wherein said step of stacking includes the substep of positioning a jig adjacent said form to guide said stacking of said progressively greater width ribbon strips.

27. The method of claim 18 wherein said steps of selecting and stacking are repeated to form two sets of bent ribbon strips, and said means for generating is attached to both sets.

* * * * *